US010677523B2

(12) United States Patent
Decker et al.

(10) Patent No.: US 10,677,523 B2
(45) Date of Patent: Jun. 9, 2020

(54) METHOD FOR COOLING A PROCESS FLOW

(71) Applicant: LINDE AKTIENGESELLSCHAFT, Munich (DE)

(72) Inventors: Lutz Decker, Winterthur (CH); Andres Kündig, Dietikon (CH)

(73) Assignee: LINDE AKTIENGESELLSCHAFT, Munich (DE)

( * ) Notice: Subject to any disclaimer, the term of this patent is extended or adjusted under 35 U.S.C. 154(b) by 135 days.

(21) Appl. No.: 15/744,937

(22) PCT Filed: Jul. 14, 2016

(86) PCT No.: PCT/EP2016/001217
§ 371 (c)(1),
(2) Date: Jan. 15, 2018

(87) PCT Pub. No.: WO2017/008910
PCT Pub. Date: Jan. 19, 2017

(65) Prior Publication Data

US 2018/0202712 A1 Jul. 19, 2018

(30) Foreign Application Priority Data

Jul. 16, 2015 (DE) ..... 10 2015 009 255

(51) Int. Cl.
*F25J 1/02* (2006.01)
*F25J 1/00* (2006.01)
*F25D 3/10* (2006.01)

(52) U.S. Cl.
CPC ..... *F25J 1/0007* (2013.01); *F25J 1/001* (2013.01); *F25J 1/0052* (2013.01); *F25J 1/0072* (2013.01); *F25J 1/0221* (2013.01); *F25J 1/0247* (2013.01); *F25J 1/0254* (2013.01); *F25J 1/0264* (2013.01); *F25D 3/10* (2013.01); *F25J 2210/06* (2013.01); *F25J 2210/42* (2013.01);
(Continued)

(58) Field of Classification Search
CPC ..... F25J 1/0022; F25J 1/0012; F25J 1/0221; F25J 1/0072; F25J 1/0007; F25J 1/0254; F25J 1/0264; F25J 1/001; F25J 2210/06; F25J 2215/02; F25J 2215/32; F25J 2245/42
See application file for complete search history.

(56) References Cited

U.S. PATENT DOCUMENTS 3,224,207 A * 12/1965 Feist ..... F25J 1/0205 62/614
3,377,811 A * 4/1968 Siegrist ..... F25B 9/004 62/608
(Continued)

OTHER PUBLICATIONS

International Search Report for PCT/EP2016/001217, dated Oct. 27, 2016, Authorized Officer: Georg Schopfer, 1 page.
(Continued)

*Primary Examiner* — Brian M King
(74) *Attorney, Agent, or Firm* — Millen White Zelano & Branigan, PC; Brion P. Heaney

(57) ABSTRACT

A method of cooling a process stream with an auxiliary stream is described, wherein the exchange of heat between the process stream and the auxiliary stream is effected in a first heat exchanger and a second heat exchanger connected downstream thereof.

9 Claims, 1 Drawing Sheet

(52) U.S. Cl.
CPC ..... *F25J 2215/02* (2013.01); *F25J 2215/30* (2013.01); *F25J 2215/32* (2013.01); *F25J 2245/02* (2013.01); *F25J 2270/12* (2013.01)

(56) References Cited

U.S. PATENT DOCUMENTS

2009/0199579 A1* 8/2009 Kundig ..... F25J 1/0007 62/115
2015/0068246 A1* 3/2015 Hakamade ..... F25B 9/02 62/607

OTHER PUBLICATIONS

Baker, C.R., Hydrogen Liquefaction Using Centifugal Compressors, Hydrogen Energy Progress, Proceedings of the World Hydrogenenergy Conf. XX, Jan. 1, 1982, pp. 1317-1333, vol. 3.

* cited by examiner

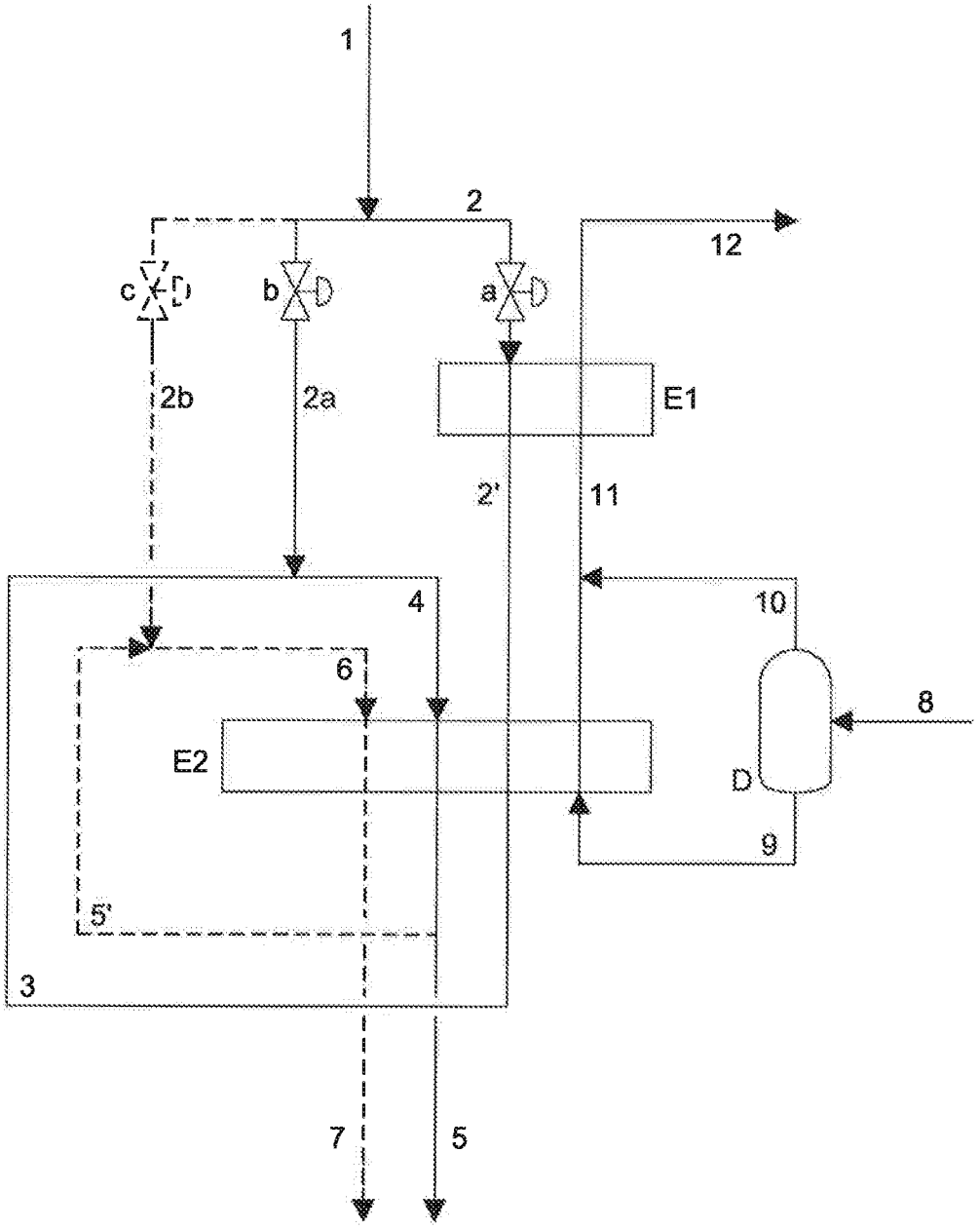
1
2
12
c
b
a
2b
2a
E1
2'
11
4
10
6
8
E2
D
9
5'
3
7
5

METHOD FOR COOLING A PROCESS FLOW

CROSS-REFERENCE TO RELATED APPLICATIONS

This application claims priority under 35 USC § 119 to International Patent Application No. PCT/EP2016/00217, filed on Jul. 14, 2016, which claims priority from German Patent Application DE 10 2014 009 255.3, filed on Jul. 16, 2015.

BACKGROUND OF THE INVENTION

The invention relates to a method of cooling a process stream with an auxiliary stream, wherein the exchange of heat between the process stream and the auxiliary stream is effected in a first heat exchanger and a second heat exchanger connected downstream thereof.

Methods of the generic type for preliminary cooling of a process stream with an auxiliary stream find use, for example, in cryogenic refrigeration systems and liquefaction plants, for example helium and neon refrigeration systems, hydrogen and helium liquefiers, etc. Refrigeration systems and liquefaction plants of this kind generally have a preliminary cooling circuit in which the process stream which is to be cooled and, if appropriate, liquefied is cooled with an auxiliary stream, for example with liquefied nitrogen ($LN_2$). Liquid nitrogen constitutes a comparatively inexpensive refrigeration source. It enables the cooling of the process stream down to a temperature of about 80 K.

The process stream is cooled here with the auxiliary stream in two series-connected heat exchangers. The auxiliary stream or liquefied nitrogen circulated, after it has been refrigeratively expanded, is separated into a liquid fraction and a gas fraction, as elucidated with reference to the FIGURE. While the liquid fraction is conducted in countercurrent to the process stream to be cooled through the two heat exchangers, first through the second, colder heat exchanger, the gas fraction is only conducted in countercurrent to the process stream to be cooled through the first, i.e. the warmer, of the two heat exchangers.

Particle accelerators, fusion research reactors etc. have comparatively large volumes of superconducting magnets and the accompanying installations. These magnets have to be cooled down from ambient temperature (about 300 K) to an operating temperature generally below 5 K. This cooling procedure can take several days and weeks. As already described at the outset, for the first cooling phase from about 300 K to about 80 K, the refrigeration required is preferably provided by inexpensive liquid nitrogen. At the same time, however, the nitrogen must not be conducted directly through the cooling channels of the magnets to be cooled, since nitrogen that remains therein would freeze in the subsequent cooling phases in which cooling is effected down to a temperature of less than 5 K, and block the channels. For this reason, indirect heat exchange between the liquefied nitrogen and the process stream to be cooled is to be implemented.

Owing to their comparatively high efficiency and compact design, preference is given to using countercurrent plate heat exchangers for this purpose. However, these heat exchanger types are sensitive to excessively high temperature gradients between the individual channels and can be damaged or destroyed by excessively high thermal expansion forces.

This risk exists especially during the above-described first cooling phase, in which the process stream to be cooled is cooled down from ambient temperature to a temperature of about 80 K. In the case of conventional cooling and liquefaction circuits, the low- or medium-pressure stream returned from the magnet or experiment to be cooled remains warm for a comparatively long period and is typically returned to the circulation compressor via a warmer at about ambient temperature. In this cooling phase, the high-pressure stream is cooled exclusively in the manner described above by the liquefied nitrogen. The heat of evaporation from the liquefied nitrogen is about the same in terms of size as the difference in enthalpy of the nitrogen through saturated vapor to ambient temperature. In the case of helium refrigeration systems and helium liquefaction plants, the enthalpy profile of helium, by contrast, is constant. Therefore, the temperature spread between the helium process stream to be cooled and the nitrogen stream is at its greatest at the level of the saturated nitrogen vapor in the region between the cold end of the warm heat exchanger and the warm end of the cold heat exchanger.

To date, this problem has been countered by temporarily permitting exceedance of the maximum permissible temperature differential between the channels of the heat exchanger(s). Owing to the risk of damage to the heat exchangers, this reduces the operational safety of the plant. There have also already been proposals to pre-evaporate and heat the liquefied nitrogen to a temperature of at least 50 K below the refrigeration circuit temperature attained—commencing at a temperature of 250 K. However, this procedure is inefficient and comparatively slow.

It is an object of the present invention to specify a method of the generic type for cooling a process stream with an auxiliary stream, in which the above-described disadvantages are avoided.

SUMMARY OF THE INVENTION

To achieve this object, a method of the generic type for cooling a process stream with an auxiliary stream is proposed, which is characterized in that a) the process stream is divided into two or more substreams,
b) the flow rates of the substreams are regulatable by means of one valve each,
c) only a first substream is cooled down with the auxiliary stream in the first and second heat exchangers, and
d) the other substream(s) is/are mixed into the cooled first substream and the process stream thus formed is cooled again in the second heat exchanger, and, in the case of division into more than two substreams, the process stream is cooled again in the second heat exchanger after each substream has been mixed in,
e) wherein the flow rates of the substreams are regulated such that the temperatures of the process streams to be cooled in the second heat exchanger, on entry into the second heat exchanger, differ from one another by not more than 10 K, and
f) wherein at least one of the valves that regulates the flow rates of the substreams is fully opened.

According to the invention, the process stream to be cooled is divided into two or more, preferably into three, substreams. The flow rates of these substreams are regulatable by means of one valve each. Only the first and largest substream is cooled down with the auxiliary stream in the first and second heat exchangers. Cooling is effected here down to a temperature of about 1 K above the temperature of the auxiliary stream. Subsequently, the second substream is mixed into the process substream cooled in this way, and the process stream thus formed is fed back to the second heat exchanger and cooled with the auxiliary stream therein. If the process stream is divided into three or more substreams, after every further substream has been mixed in, the process stream thus formed is cooled again with the auxiliary stream in the second heat exchanger. According to the invention, the flow rates of the two or more substreams are regulated such that all the process streams to be cooled, at the inlet of the second heat exchanger, have approximately equal temperatures. More particularly, the temperatures of the process streams to be cooled, at the inlet of the second heat exchanger, differ from one another by not more than 10 K, preferably by not more than 5 K, especially by not more than 2 K. Temporary control deviations up to 10 K, preferably up to 5 K, especially up to 2 K, are thus tolerable. In addition, at least one of the valves that regulate the flow rates of the two or more substreams is completely open. As a result, the number of control elements (n+1 valves) is matched to the number of controlled variables (n temperature differentials). At the same time, the pressure drop in the process stream is minimized.

According to the invention, a substream of the process stream to be cooled is now passed through the first heat exchanger; this has the consequence that the thermal load is reduced, while the load in the auxiliary stream evaporator rises. Thus, there is distinct conformance of the temperatures between the process stream and the auxiliary stream. While the maximum temperature differential in the methods of the prior art is more than 100 K, it can be lowered by two or more mixing-in operations/division into three or more substreams to less than 50 K. Thus, the temperature differential is below the maximum temperature differential permissible for plate heat exchangers, which, according to the manufacturer and geometry of the heat exchanger, is between 50 and 100 K.

If the maximum permissible temperature differential in the heat exchangers used is at least 70 K, it is fundamentally sufficient when the process stream to be cooled is divided into just two substreams. In this case, a second or further mixing-in of substreams is not absolutely necessary.

By means of the procedure of the invention, the maximum temperature differential that occurs can be reduced further by more than two mixing-in operations.

Owing to the procedure of the invention, in the case of a helium refrigeration system, the entire high-pressure helium stream available in the refrigeration circuit, from the start of the cooling phase onward, can be cooled with liquefied nitrogen without exceeding the maximum permissible temperature differential between the individual channels in the plate heat exchangers. The outlay on additional equipment and additional logic circuits which is required for the implementation of the method of the invention is comparatively low. The method of the invention additionally assures full operational safety at all times.

Further advantageous configurations of the method of the invention for cooling a process stream with an auxiliary stream, which constitute the subject matter of the dependent claims, are characterized in that

- the flow rates of the substreams are regulated such that the temperatures of the process streams to be cooled in the second heat exchanger, on entry into the second heat exchanger, differ from one another by not more than 5 K, preferably by not more than 2 K,
- the first heat exchanger and/or the second heat exchanger take(s) the form of a plate exchanger,
- the process stream to be cooled is a hydrogen-, helium- or neon-rich gas, and
- the auxiliary stream is a nitrogen-rich liquid and/or a nitrogen-rich gas.

The terms "hydrogen-rich gas", "helium-rich gas", "neon-rich gas", "nitrogen-rich liquid" and "nitrogen-rich gas" shall each be understood to mean gases or liquids wherein the proportion of the components mentioned is at least 90% by volume, preferably at least 95% by volume, especially at least 99% by volume.

BRIEF DESCRIPTION OF THE DRAWINGS

The method of the invention for cooling a process stream with an auxiliary stream and further advantageous configurations thereof will be elucidated in detail hereinafter with reference to the working examples shown in the FIGURE.

DETAILED DESCRIPTION OF THE INVENTION

What are shown are two embodiments of the method of the invention for cooling a process stream with an auxiliary stream, as implementable, for example, in cryogenic helium and neon refrigeration systems, hydrogen and helium liquefiers, etc. The process stream to be cooled shall be helium hereinafter, while the auxiliary stream is a nitrogen-rich stream.

The helium process stream 1 to be cooled, in accordance with a first embodiment shown in the FIGURE, is divided into two substreams 2 and 2*a*. The valves a and b serve to regulate the flow rates of the two substreams. The first and largest substream 2 is cooled in the heat exchangers E1 and E2 down to a temperature of about 1 K above the temperature of the auxiliary stream or liquefied nitrogen 9.

A refrigeratively expanded, nitrogen-rich stream 8 is separated in the separator D into a liquid fraction 9 and a gas fraction 10. Only the liquid fraction 9 is guided through the heat exchanger E2 in countercurrent to the above-described helium substream 2' to be cooled in the heat exchanger E2 and mixed with the gas fraction 10, and the combined nitrogen-rich substream 11 is then guided through the heat exchanger E1 in countercurrent to the helium substream 2 to be cooled, before it is drawn off via conduit 12 and fed back to a circulation compressor not shown in the FIGURE.

Then the second helium substream 2*a* is mixed into the helium substream 3 cooled down in heat exchangers E1 and E2. The helium process stream 4 formed in this way is cooled in the heat exchanger E2; the cooled helium process steam 5 is then fed to the load to be cooled and/or to at least one expansion apparatus.

If there are to be at least two mixing-in operations of helium substreams into the helium substream 2 to be cooled in the heat exchangers E1 and E2, separation of the helium process stream 1 into three substreams 2, 2*a* and 2*b* is required. This variant is shown in the FIGURE by the conduit sections 2*b*, 5', 6 and 7 shown by dotted lines and the control valve c shown by dotted lines. In this embodiment of the method of the invention, the helium process stream 5' cooled in the heat exchanger E2 after the helium substream 2*a* has been mixed in is not drawn off via conduit 5. Instead, the third helium substream 2*b* is mixed into it and the helium process stream 6 thus formed is cooled in the heat exchanger E2 before being drawn off via conduit 7.

Irrespective of whether the helium process stream 1 to be cooled is divided into two, three or more than three helium substreams 2, 2*a*, 2*b*, . . . , the flow rates of the helium substreams 2, 2*a* and 2*b* should be regulated by means of the control valves a, b and c such that the temperatures of the process streams 2', 4 and 6 to be cooled in the second heat exchanger differ from one another by not more than 10 K, preferably by not more than 5 K, especially by not more than 2 K.

If control/regulation valves that are required only during particular operating states, for example in sustained operation, are provided within a refrigeration system or liquefaction plant, these may assume the function(s) of one of the above-described control valves a, b and c. By means of this embodiment, the additional outlay on required fittings or valves can be reduced.

What we claim is:

1. A method of cooling a process stream with an auxiliary stream, wherein an exchange of heat between the process stream and the auxiliary stream is affected in a first heat exchanger and a second heat exchanger connected downstream of the first heat exchanger, said process comprising:

a) dividing the process stream into a first substream, a second substream, and optionally one or more further substreams, b) regulating the individual flow rate of each substream by a valve associated therewith, c) cooling said first substream by heat exchange with the auxiliary stream in both the first exchanger and the second heat exchanger, to form a cooled first substream, d) mixing the second substream with the cooled first substream to form a combined substream and cooling the combined substream in the second heat exchanger to form a cooled combined substream, and e) if said process stream is divided into said one or more further substreams, mixing each of said further substreams with said cooled combined substream and cooling the resultant combined substream in the second heat exchanger after each further substream has been mixed in, wherein the flow rates of the substreams are regulated such that the temperatures of the substreams to be cooled in the second heat exchanger, on entry into the second heat exchanger, differ from one another by not more than 10 K, and wherein at least one of the valves that regulate the flow rates of the substreams is fully opened.

2. The method as claimed in claim 1, wherein the flow rates of the substreams are regulated such that the temperatures of the substreams to be cooled in the second heat exchanger, on entry into the second heat exchanger, differ from one another by not more than 5 K.

3. The method as claimed in claim 1, wherein the first heat exchanger and/or the second heat exchanger is/are plate heat exchangers.

4. The method as claimed in claim 1, wherein the process stream to be cooled is a hydrogen-rich gas, a helium-rich gas, or a neon-rich gas.

5. The method as claimed claim 1, wherein the auxiliary stream is a nitrogen-rich liquid or a nitrogen-rich gas.

6. The method as claimed in claim 2, wherein the temperatures of the substreams to be cooled in the second heat exchanger, on entry into the second heat exchanger, differ from one another by not more than 2 K.

7. The method as claimed claim 1, wherein, prior to heat exchange in the first heat exchanger and the second heat exchanger, the auxiliary stream is separated in a separator into a liquid fraction and a gas fraction, the liquid fraction is subjected to heat exchange in the second heat exchanger and then mixed with the gas fraction to form a combined auxiliary stream, and the combined auxiliary stream is then subjected to heat exchange with the first substream in the first heat exchanger.

8. A method of cooling a process stream with an auxiliary stream, wherein an exchange of heat between the process stream and the auxiliary stream is affected in a first heat exchanger and a second heat exchanger connected downstream of the first heat exchanger, said process comprising:

a) dividing the process stream into at least a first substream and a second substream, b) regulating the flow rate of the first substream by a first valve, and regulating the flow rate of the second substream by a second valve, c) cooling said first substream by heat exchange with the auxiliary stream in both the first exchanger and the second heat exchanger, to form a cooled first substream, d) mixing the second substream with the cooled first substream to form a combined substream and cooling the combined substream in the second heat exchanger to form a cooled combined substream, and wherein the flow rates of the first and second substreams are regulated such that the temperatures of the substreams to be cooled in the second heat exchanger, on entry into the second heat exchanger, differ from one another by not more than 10 K, and wherein at least one of the first valve and the second valve that regulate the flow rates of the first and second substreams is fully opened.

9. A method of cooling a process stream with an auxiliary stream, wherein an exchange of heat between the process stream and the auxiliary stream is affected in a first heat exchanger and a second heat exchanger connected downstream of the first heat exchanger, said process comprising:

a) dividing the process stream at least a first substream, a second substream, and a third substream, b) regulating the flow rates of said first, second and third substreams by a first valve, a second valve, and a third valve, respectively c) cooling said first substream by heat exchange with the auxiliary stream in both the first exchanger and the second heat exchanger, to form a cooled first substream, d) mixing the second substream with the cooled first substream to form a combined substream and cooling the combined substream in the second heat exchanger to form a cooled combined substream, and e) mixing the third substream with the cooled combined substream to form a further combined substream and cooling the further combined substream in the second heat exchanger to form a cooled further combined substream, wherein the flow rates of the first, second, and third substreams are regulated such that the temperatures of the substreams to be cooled in the second heat exchanger, on entry into the second heat exchanger, differ from one another by not more than 10 K, and wherein at least one of said first, second, and third valves is fully opened.

* * * * *